US006786381B2

(12) United States Patent
Shkolnikov

(10) Patent No.: US 6,786,381 B2
(45) Date of Patent: Sep. 7, 2004

(54) ANTI-OXIDANT BATTERY CONTACTS FOR FASTENER-DRIVING TOOL

(75) Inventor: Yury Shkolnikov, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/155,766

(22) Filed: May 24, 2002

(65) Prior Publication Data

US 2003/0218045 A1 Nov. 27, 2003

(51) Int. Cl.[7] ..... B25C 1/04; B25C 5/02; B25C 5/06

(52) U.S. Cl. ..... 227/130; 227/156; 227/10; 173/217; 310/50

(58) Field of Search ..... 227/130, 10; 429/97; 310/47, 50; 173/217

(56) References Cited

U.S. PATENT DOCUMENTS 4,586,777 A * 5/1986 Wied ..... 439/358
5,259,769 A * 11/1993 Cruise et al. ..... 439/65
5,401,592 A * 3/1995 Gilpin et al. ..... 429/97
5,473,242 A * 12/1995 McKenna ..... 320/113
6,179,192 B1 1/2001 Weinger et al.
6,357,534 B1 * 3/2002 Buetow et al. ..... 173/217
6,551,143 B2 * 4/2003 Tanaka et al. ..... 439/682

OTHER PUBLICATIONS

Corrosion Doctor, www.corrosion–doctors.org/MatSelect/corrsilver.htm, Silver Corrosion Dec. 27, 2001.*
Corrosion Doctor, www.corrosion–doctors.org/MatSelect/corrchromium.htm, Chromium Corrosion Dec. 27, 2001.*
MiningTrading.com, www.miningtrading.com/silver, Silver, Copyright 2000.*
MiningTrading.com, www.miningtrading.com/gold, Gold, Copyright 2000.*

* cited by examiner

*Primary Examiner*—Scott A. Smith
*Assistant Examiner*—Brian Nash
(74) *Attorney, Agent, or Firm*—Lisa M. Soltis; Mark W. Croll; Donald J. Breh

(57) ABSTRACT

A fastener driving tool includes a housing defining a cavity for insertion of at least one battery, a battery configured for insertion into the cavity and having at least one battery contact element, a terminal module disposed in the cavity, constructed and arranged for engaging the battery and making an electrical connection therewith, the module including at least one terminal module contact element. At least one of the battery and terminal module contact elements incorporates a precious metal alloy and the other of the contact elements is conductive. The respective contact elements are configured for oxidation-free operation in the range of at least about 100 g's.

7 Claims, 3 Drawing Sheets

ANTI-OXIDANT BATTERY CONTACTS FOR FASTENER-DRIVING TOOL

BACKGROUND OF THE INVENTION

The present invention relates generally to fastener driving tools used for driving fasteners into workpieces, and specifically to fastener driving tools employing batteries for powering certain tool functions.

Conventional fastener driving tools feature a reciprocating driver blade which impacts a fastener fed to a nosepiece by a magazine. Typically, as exemplified in Nikolich U.S. Pat. No. Re. 32,452, Nikolich U.S. Pat. No. 4,522,162; Nikolich U.S. Pat. No. 4,483,474; Nikolich U.S. Pat. No. 4,403,722 and Wagdy U.S. Pat. No. 4,483,473; as well as U.S. Pat. Nos. 5,197,646 and 5,263,439, all of which are incorporated by reference, a combustion-powered, fastener-driving tool includes a combustion chamber, which is defined by a cylinder body and by a valve sleeve arranged for opening and closing the combustion chamber. Generally, similar combustion-powered, nail- and staple-driving tools are available commercially from ITW-Paslode (a unit of Illinois Tool Works Inc.) of Vernon Hills, Ill., under its IMPULSE trademark.

An advantage of such tools is that they are totally portable, and as such do not require a connection to a supply of electricity or pneumatic fluid power. Combustion from a self-contained "engine" provides the power needed to drive the fasteners. However, supplemental battery power is needed to operate ancillary tool systems, such as the spark generation, fan motor power, warning lights and other functions well known to skilled practitioners. In more recent models of such tools, a rechargeable battery is provided for supplying the required power.

One disadvantage of the stressful operational environment of such tools is that the tremendous force of combustion exerts significant vibration and/or gravitational (g) forces on the tool components, including the battery and its connection point to the tool, commonly known as a terminal block. In fact, it has been found that such tools generate internal forces of at least 100 g's, and reaching in the range of 300–500 g's. This level of vibration and shock forces is now known to cause movement of the battery relative to the terminal block to the extent that the electrical contact between the battery and the terminal block is temporarily interrupted during combustion events due to micro-arcing.

This interruption is almost imperceptible, lasting only in the range of a few milliseconds. However, the interruptions are significant to the extent that, over time, the repetitive micro-arcing has been found to cause oxidation corrosion of the interface contacts between the terminal block and the battery. Especially when the respective contact surfaces are made of Cu—Ni alloys, after prolonged use, the corrosion impairs tool performance due to insufficient power reaching the tool from the battery. Ultimately, a conductivity breach occurs.

Faced with this problem, tool users must clean the contacts of the terminal block and the battery to remove corrosion. While the battery is removable from the tool and as such accessible for cleaning, the terminal block is difficult to access without significant disassembly of the tool. Such disassembly by unskilled tool users can cause unwanted problems due to improper reassembly.

Another design objective of such combustion tools is that the battery/terminal module interface maintains adequate electrical conductivity in the face of the at least about 100 g's to which such tools are subjected during combustion.

Still another design objective of the battery/terminal module interface of such tools is that the contact elements forming the interface are designed to accommodate the insertion and withdrawal of the battery from the tool without causing undue wear and tear on the contact elements.

Thus, there is a need for a combustion tool featuring a battery/terminal block interface which accommodates the micro-arcing without generating oxidation or other corrosion. There is also a need for a combustion tool featuring a battery/terminal block interface which can withstand at least about 100 g's and maintains good conductivity without causing undue wear on the battery/terminal module contact elements.

BRIEF SUMMARY OF THE INVENTION

The above-identified design considerations are addressed by the present battery/terminal module interface in which the contact elements are able to withstand at least about 100 g's without generating corrosive oxidation. At the same time, conductivity is maintained and the cost of the contact interface elements is competitive with the conventional Cu—Ni contact interfaces.

More specifically, a fastener driving tool is provided including a housing defining a cavity for insertion of at least one battery, a battery configured for insertion into the cavity and having at least one battery contact element. A terminal module is disposed in the cavity, and is constructed and arranged for engaging the battery and making an electrical connection therewith, the module including at least one terminal contact element. At least one of the battery and terminal module contact elements incorporates a precious metal alloy and the other of the contact elements is conductive.

In another embodiment, the contact interface is configured for a smooth transition between the respective contact elements. Another feature of the present invention is that the contact interface is capable of withstanding at least about 100 g's and maintaining contact without suffering from oxidation-type corrosion.

DETAILED DESCRIPTION OF THE INVENTION

Figure 1:
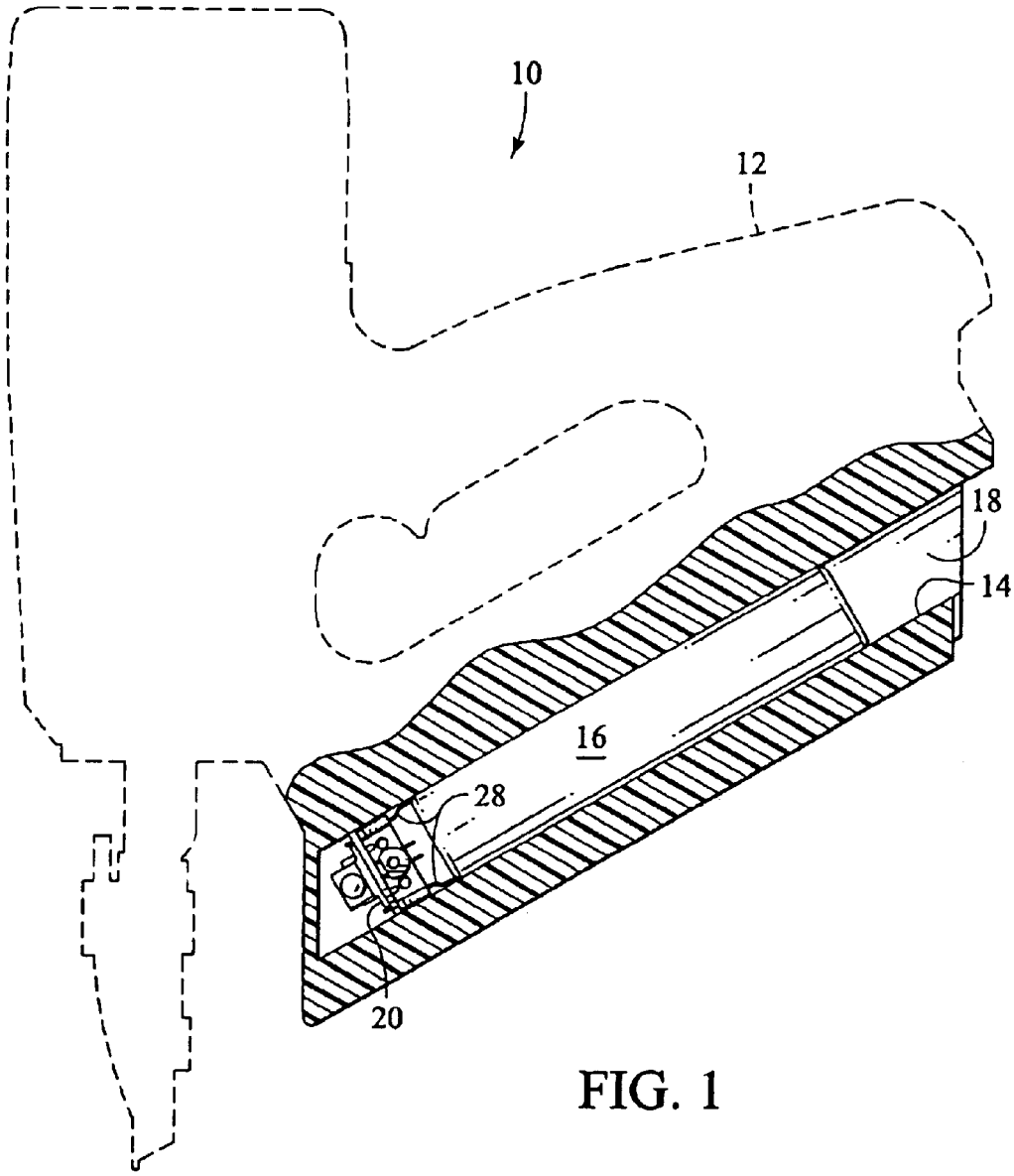
FIG. 1 is a side view of a fastener-driving tool featuring the present battery/terminal module interface connection, with portions omitted for clarity.

Referring now to FIG. 1, a fastener-driving tool suitable for use with the present invention is generally designated 10 and includes a housing 12 (shown in phantom), the operational details of the tool and housing are described in significant detail in the patents listed above which have been incorporated by reference. Examples of such tools are sold under the trademark PASLODE® by Illinois Tool Works, Inc., the present assignee.

Included in the housing 12 is a generally tubular cavity 14 configured for receiving at least one battery 16. An opening 18 is defined in the cavity 14 through which the battery is inserted. At the opposite end from the opening 18, the cavity 14 has a battery terminal module 20 which electrically connects the battery 16 to other functional components of the tool, as are known in the art. While only one battery 16 is depicted, it is contemplated that several batteries may be provided which are connectable in series as is also known in the art. The terminal module 20 is secured within the cavity 14 by threaded fasteners, chemical adhesives, ultrasonic welding, insert molding or other known fastening technologies.

As described above, one of the operational concerns regarding tools of this type is that the significant vibrational and shock forces generated during combustion, which range from at least about 100 g's to in the range of 300–500 g's, has been known to cause micro-arcing between corresponding engaged contacts of the battery 16 and the terminal module 20. Prolonged micro-arcing leads to corrosion of the contacts and in some cases leads to disruption of the battery connection.

Figure 2:
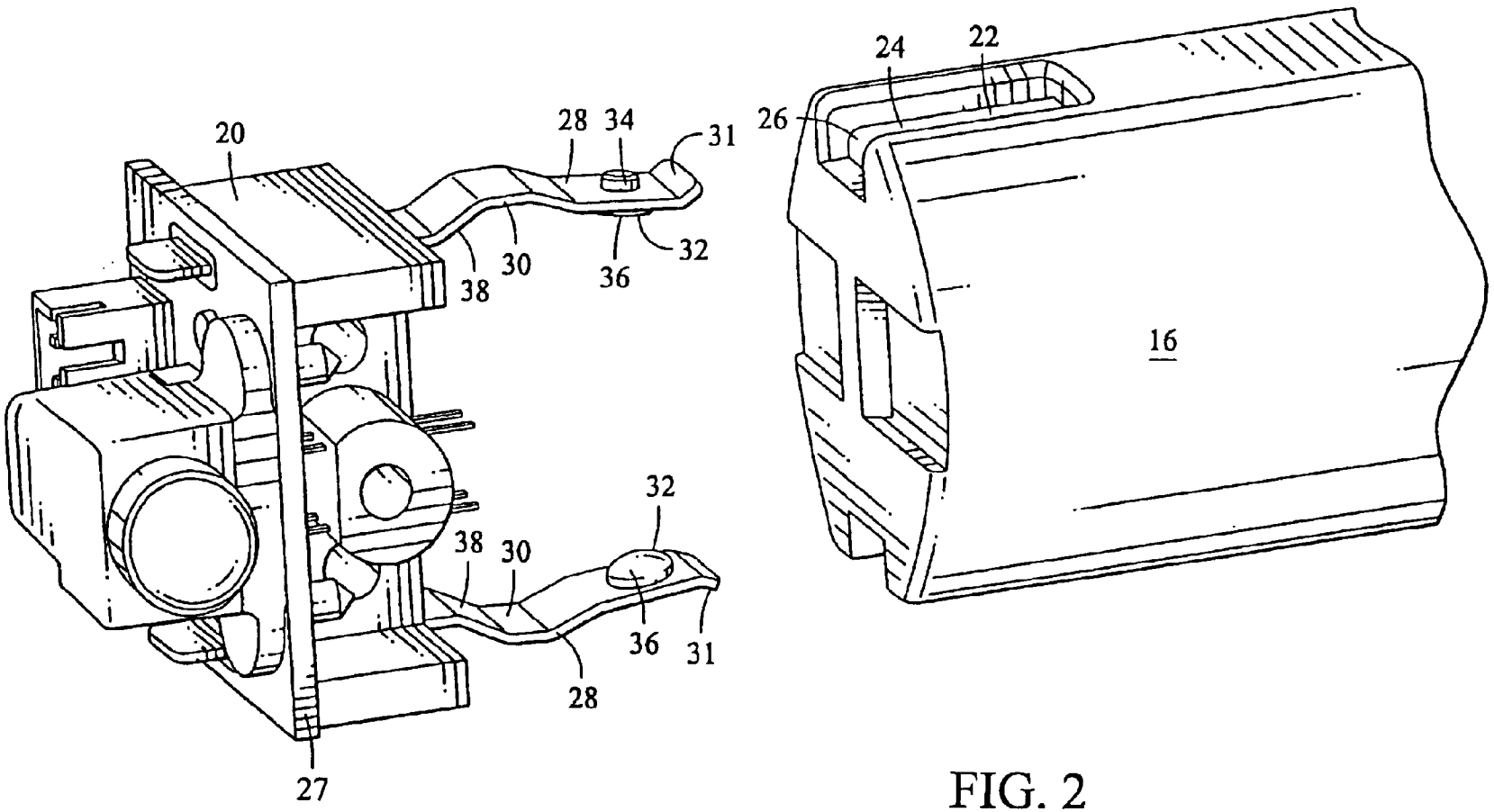
FIG. 2 is a perspective view of the battery/terminal module assembly showing the components engaged.
Figure 3:
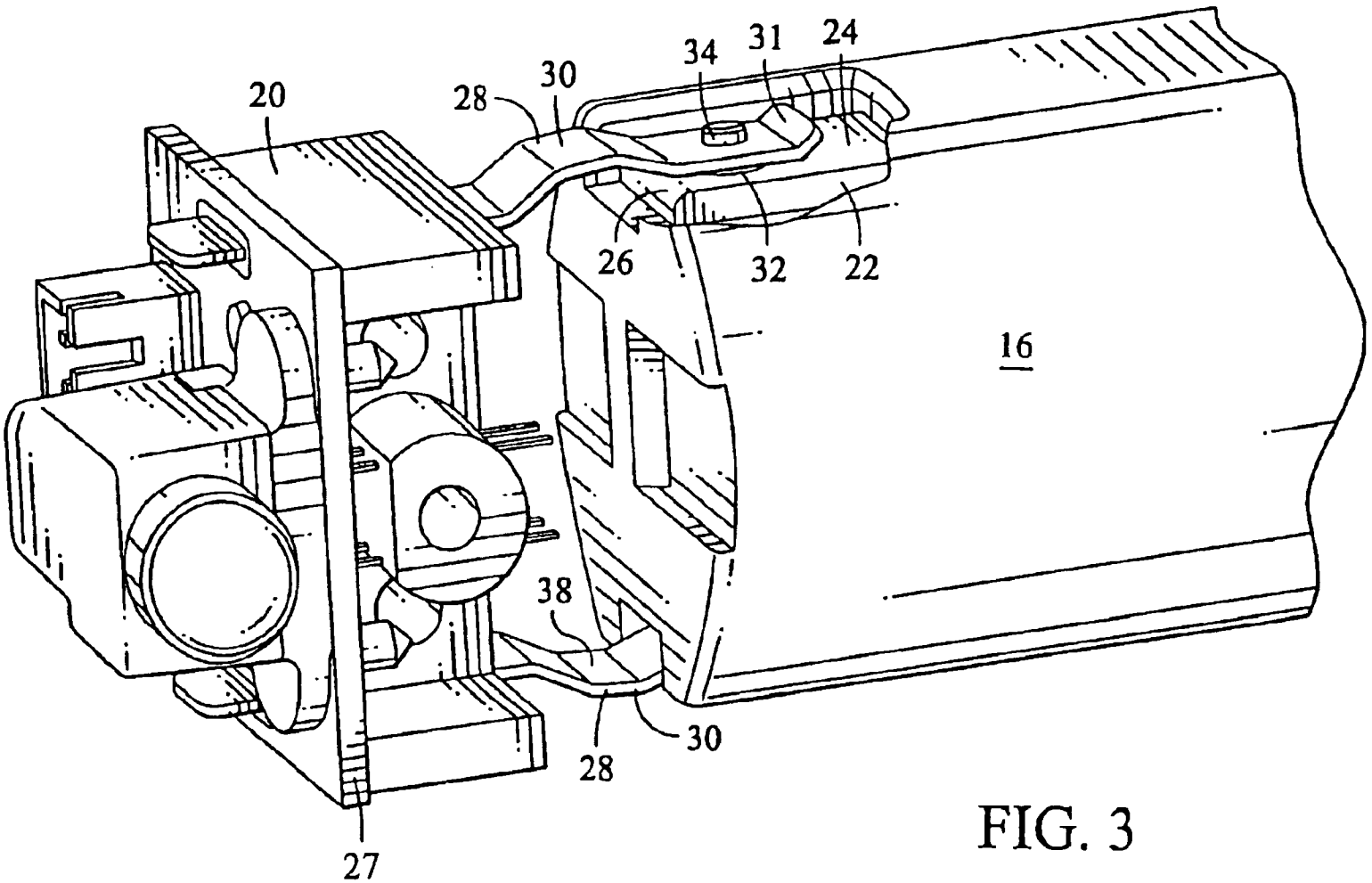
FIG. 3 is an exploded perspective view of the components of FIG. 2.

Referring now to FIGS. 2 and 3, the battery 16 has at least one battery contact element 22 which, in the preferred embodiment includes a generally planar contact surface 24 and a terminal engagement edge 26. In the preferred embodiment, there are two such contact elements 22, and the terminal engagement edge 26 is radiused to promote and facilitate sliding connection between the battery 16 and the terminal module 20. It is contemplated that the number and configuration of the battery contact elements 22 may vary to suit the application.

The terminal module 20 includes a housing 27 from which extend at least one and preferably two spring-biased clips 28. Each clip 28 preferably includes an arched portion 30 and an inclined or dovetailed end portion 31. The arched portion 30 increases the gripping force of the clip 28 against the battery contact element 22, and the configuration of the end portion 31 facilitates a smooth transition with the battery terminal engagement edge 26. In the preferred embodiment, the clips 28 are made of phosphorous/bronze or beryllium/copper alloys, however other spring-like, conductive and durable materials are contemplated. The precise arrangement and configuration of the spring-biased clips 28 may vary to suit the application, as long as the clips generate a biasing force which urges at least one terminal module contact element 32, also sometimes referred to as a terminal contact element, against the battery contact 22.

Between the arched portion 30 and the end portion 31 is disposed the corresponding module contact element 32. While any shaped contact element 32 is contemplated, it is preferred that the contact element has a hemi-spherical or dome shaped configuration which is radiused or otherwise configured for a smooth contact transition with the corresponding battery contact element 22.

To prevent corrosion, it is important that both the battery contact element 22 and the terminal module contact element 32 be made of a material which accommodates the above-described micro-arcing as much as possible without reacting with the opposing or interfacing contact element. At the same time, the respective contact elements should be made of a material which is sufficiently conductive to maintain adequate tool performance.

Best results have been obtained when at least one of the battery and terminal module contact elements 22, 32 incorporates a precious metal alloy and the other of the contact elements is conductive. More specifically, the preferred precious metal is an alloy of gold, silver or platinum, and the conductive element is made of stainless steel. Conventionally available precious metal alloys are preferred due to their increased hardness and durability over the pure precious metal. Such alloys include, but are not limited to Ag—Cu, Ag—Cu—Ni, Ag—C and Ag—Pd. Besides those mentioned, it is contemplated that other precious metal alloys may also be suitable depending on availability and cost. Also, for the conductive contact element, either precious metal or some other conductive material which resists corrosion and has a relatively high conductivity and low cost. While stainless steel does not have particularly good conductivity values, and as such it is not typically used in a contact element application, it does have good anti-corrosion properties.

To achieve production-level efficiencies, it is preferred that the battery contact elements 22 are made of stainless steel and the terminal module contact elements 32 are made of precious metal alloy. Silver alloy is particularly preferable due to a combination of oxidative corrosion resistance, conductivity, durability and cost factors. Also, the terminal module contact elements 32 are preferably provided in the form of rivets which are frictionally engaged in openings 34 in a corresponding spring clip 28. While the above-described rivets are preferred, it is anticipated that other types of contact attachment technologies may be employed for attaching the contact element 32 to the spring clips 28 including, but not limited to crimping, threaded fasteners, inlay technology or the like. It is also contemplated that, depending on the application, the battery contact elements 22 are made of precious metal alloys and the terminal module contact elements 32 are made of stainless steel or combinations of the above, where one of each contact elements 22, 32 is made of precious metal and the other is conductive or stainless steel.

It has been found that the combination of stainless steel and precious metal alloy contacts provides the required level of conductivity while retaining anti-oxidation properties desired for preventing the micro-arcing-caused corrosion.

Each rivet 32 is provided with a spherical or domed surface 36 located on an inner surface 38 of the corresponding spring clip 28 to properly engage the battery contact element 22 as the battery 16 is completely inserted into the cavity 14. In this manner, the spherical configuration of the terminal contact element 32 is provided with a smooth transition as it slidingly engages the battery contact element 22 during battery insertion. Thus, the above-described smooth transition of the interfacing contact elements 22, 32 is achieved by a combination of the radiused terminal engagement end 26, the dovetailed clip end 31 and the domed configuration of the rivet 32.

Another feature of the present combination of interfacing contact elements is that the above-described materials provided in the present configuration have been found to withstand, and maintain corrosion-free conductivity while subject to the significant vibration and g forces typically found in combustion powered fastener driving tools. Operational forces in such tools reach at least about 100 g's and often achieve or exceed forces in the range of 300–500 g's.

While specific embodiments of the anti-oxidant battery contacts for a fastener-driving tool of the present invention have been shown and described, it will be appreciated by those skilled in the art that changes and modifications may be made thereto without departing from the invention in its broader aspects and as set forth in the following claims.

What is claimed is:

1. A fastener driving tool, which, during operation, exerts at least one of significant vibration and gravitational (g) forces on tool components, the tool comprising:

a housing defining a cavity for insertion of at least one battery;

a battery configured for insertion into said cavity and having at least one battery contact element;

a terminal module disposed in said cavity, constructed and arranged for engaging said battery contact element and making an electrical connection therewith, said module including at least one terminal contact element, said electrical connection formed between opposing ones of said at least one terminal module contact element and said at least one battery contact element subject to micro-arcing during operation of the tool and the exposure to the significant vibration and gravitational forces, said contact element configuration providing oxidation-free operation when operation of the tool exerts forces of at least 300 g's, whereby such vibration and gravitational forces potentially interfere with the connection between said contact elements;

wherein only one of said battery contact elements and said at least one terminal module contact elements in each set of opposing contacts incorporates a precious metal alloy taken from the group consisting of silver, gold, and platinum and the other opposing contact element is conductive, the conductive element including stainless steel.

2. The tool of claim 1 wherein said precious metal alloy is provided on said at least one terminal module contact element.

3. The tool of claim 2 wherein said at least one contact element having said precious metal alloy is provided in the form of a rivet, and said at least one battery contact element is made of a conductive material.

4. The tool of claim 1 wherein said at least one battery contact element has a generally planar contact surface and a radiused terminal engagement edge.

5. The tool of claim 1 wherein said terminal module contact elements are dome-shaped or hemi-spherical, and said battery contact elements have a radiused terminal engagement edge.

6. A combustion-powered fastener driving tool which during operation exerts at least one of significant vibration and gravitational (g) forces on tool components, the tool comprising:

a housing defining a cavity for insertion of at least one battery;

a battery configured for insertion into said cavity and having at least one battery contact element, said at least one contact element being generally planar and having a radiused terminal engagement end; and a terminal module disposed in said cavity, constructed and arranged for engaging said battery and making an electrical connection therewith, said module including at least one spring-biased clip having at least one terminal module contact element being radiused for engagement with said terminal engagement end, said at least one spring biased clip being configured for urging said at least one terminal module contact element for facilitating a sliding connection against said generally planar surface, said electrical connection formed between opposing ones of said at least one terminal module contact element and said at least one battery contact element subject to micro-arcing during operation of the tool and the exposure to the significant vibration and gravitational forces, said contact element configuration providing oxidation-free operation when operation of the tool exerts forces of at least 300 g's, whereby such vibration and gravitational forces potentially interfere with the connection between said contact elements;

wherein only one of said battery contact elements and said at least one terminal module contact elements in each set of opposing contacts incorporates a precious metal alloy taken from the group consisting of silver, gold, and platinum and the other opposing contact element is conductive, the conductive element including stainless steel.

7. The tool of claim 6 wherein said precious metal is provided as a rivet fastened to a spring clip of said at least one terminal module.

* * * * *